US008539777B2

(12) United States Patent
Henry

(10) Patent No.: US 8,539,777 B2
(45) Date of Patent: Sep. 24, 2013

(54) CAN COOLING DEVICE

(76) Inventor: Daven Lee Henry, Saint Petersburg, FL (US)

( * ) Notice: Subject to any disclaimer, the term of this patent is extended or adjusted under 35 U.S.C. 154(b) by 414 days.

(21) Appl. No.: 13/065,657

(22) Filed: Mar. 28, 2011

(65) Prior Publication Data

US 2012/0247128 A1 Oct. 4, 2012

(51) Int. Cl.
*F25D 5/02* (2006.01)
*F24J 1/00* (2006.01)

(52) U.S. Cl.
USPC ..... 62/4; 126/263.01

(58) Field of Classification Search
USPC ..... 62/4, 457.4, 457.1; 220/592.16, 220/630, 632, 737, 739, 903; 126/263.01, 126/263.05, 263.06, 263.07, 263.08, 263.09
See application file for complete search history.

(56) References Cited

U.S. PATENT DOCUMENTS 5,255,812 A * 10/1993 Hsu ..... 220/277
5,628,304 A * 5/1997 Freiman ..... 126/263.09
6,128,906 A * 10/2000 Sillince ..... 62/4
2005/0160743 A1 * 7/2005 Dunwoody ..... 62/4

* cited by examiner

*Primary Examiner* — Frantz F. Jules
*Assistant Examiner* — Webeshet Mengesha
(74) *Attorney, Agent, or Firm* — Daven Lee Henry

(57) ABSTRACT

A can cooling device that includes a beverage can insulating sleeve, a cylindrical flexible bellows attached to the bottom of the sleeve and a bottom plate. A chemically activated cooling cartridge resides within the flexible bellows A cartridge push plate and compression spring reside within the bellows directly under the cooling cartridge. The cooling cartridge includes an outer flexible enclosure that houses a powder, an inner flexible enclosure containing a liquid, and a rigid plate with upwardly directed attached prongs. When a user presses down on the beverage can, the cooling cartridge is compressed causing the upwardly directed prongs to impale the liquid holding flexible inner enclosure and causing the liquid to mix with the powder causing an endothermic cooling reaction causing the beverage can inside the insulating sleeve to be cooled in relation to the surrounding outside temperature.

1 Claim, 5 Drawing Sheets

CAN COOLING DEVICE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable cooling devices and more specifically to can cooling device.

Many beverages are currently held in thin walled metal cans that have pop tops. The cans typically hold twelve fluid ounces of liquid such as soda or beer. Most of the beverages held in cans are best served in a cooled state.

Standard home refrigerators cool items stored within them to approximately forty-five degrees F. There are times when access to a home refrigerator is not possible. During these times it would be advantageous to have access to a portable cooling device that could cool a canned beverage, while not needing access to an electrical power source such as a refrigerator.

To this end, chemicals that produce an endothermic reaction can be activated and placed in close proximity to the canned beverage to cool it. The technology to produce an endothermic reaction is well known and has been used in consumer products. For example cooling packs are sold for placing on a body part to help reduce swelling after an injury. To activate the pack the user squeezes a bag which causes an inner bag to rupture. The liquid from the inner bag mixes with powder that surrounds it to cause the endothermic reaction. Roger Quincy et al in his patent application 2008/0053109 discloses a sleeve that can be wrapped around a beverage. The sleeve has materials inside it that can produce an endothermic reaction when the sleeve is squeezed by the user.

However, there are deficiencies in the prior technology. The placement of an endothermic reaction sleeve around a standard beverage can does not allow for the addition of an effective insulating sleeve. If one were to place an insulating sleeve around the cooling sleeve, the resulting diameter would be too large to be easily grasped by a person while drinking a canned beverage contained within the sleeve. Additionally, the liquid and powder within the sleeve must be kept in a uniform consistency throughout the sleeve. The natural gravitational forces will tend to cause the liquid portion to settle at the bottom of the sleeve thereby not allowing an even cooling of the can from top to bottom. Finally, although mention is made to squeezing the sleeve to break a membrane within the sleeve for combining the two ingredients, the act of squeezing may only cause the liquid to be displaced to another portion of the sleeve, and not actually burst the membrane.

BRIEF SUMMARY OF THE INVENTION

The primary object of the invention is to provide a can cooling device that uses replaceable cooling cartridges to reduce the temperature of a standard beverage can.

Another object of the invention is to provide a can cooling device that is portable and relatively inexpensive to manufacture.

Another object of the invention is to provide a can cooling device that insulates the sides of the can to prolong the cooling effect.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a can cooling device comprising: a can insulating sleeve, a rigid sleeve retaining ring, an cylindrical flexible bellows, a bellows bottom rigid retaining ring, a rigid bottom plate, a chemically activated cooling cartridge, a cartridge push plate, a compression spring, said can insulating sleeve fixedly connected to the top of said rigid sleeve retaining ring, the top portion of said cylindrical bellows fixedly attached to the bottom portion of said rigid sleeve retaining ring, the bottom portion of said cylindrical bellows fixedly attached to the top portion of said bellows bottom rigid retaining ring, said cooling cartridge removably retained within said cylindrical bellows, the top of said compression spring attached to the underside of said cartridge push plate, said push plate providing an upwardly directed force to help said cooling cartridge be in intimate contact with the underside of a beverage can located within said can insulating sleeve, the bottom of said compression spring attached to the top surface of said rigid bottom plate, said bottom plate removably retained by standard attachment means to the underside of said bellows bottom retaining rigid ring, said cooling cartridge comprised of an outer flexible enclosure which houses a powder material, a rigid plate having attached upwardly directed prongs and an inner flexible enclosure housing a liquid, so that when a user presses down on said beverage can, said cooling cartridge is compressed causing said upwardly directed prongs to impale said liquid holding flexible inner enclosure and causing said liquid to mix with said powder causing an endothermic cooling reaction, and said cooling reaction causing said beverage can to be cooled in relation to said surrounding outside temperature.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
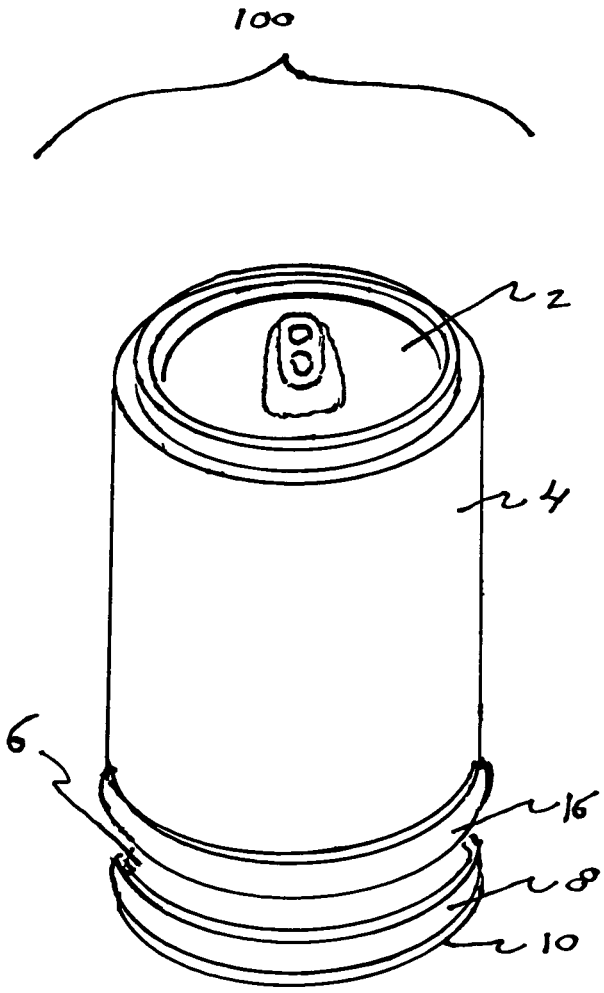
FIG. 1 is a perspective view of the invention.

Referring to FIG. 1 we see a perspective view of the invention 100. A standard beverage can 2 is housed inside insulating sleeve 4. The insulating sleeve 4 is well known and is usually comprised of a sheet of neoprene material covered with a printable lycra cover. The bottom of the sleeve 4 is attached to a rigid circular ring 16. A flexible bellows 6 is attached to the underside of the ring 16 on one side and to a lower bellows ring 8. Lower bellows ring 8 is molded of rigid plastic. A bottom plate 10 is removably attached to lower bellows ring 8.

Figure 2:
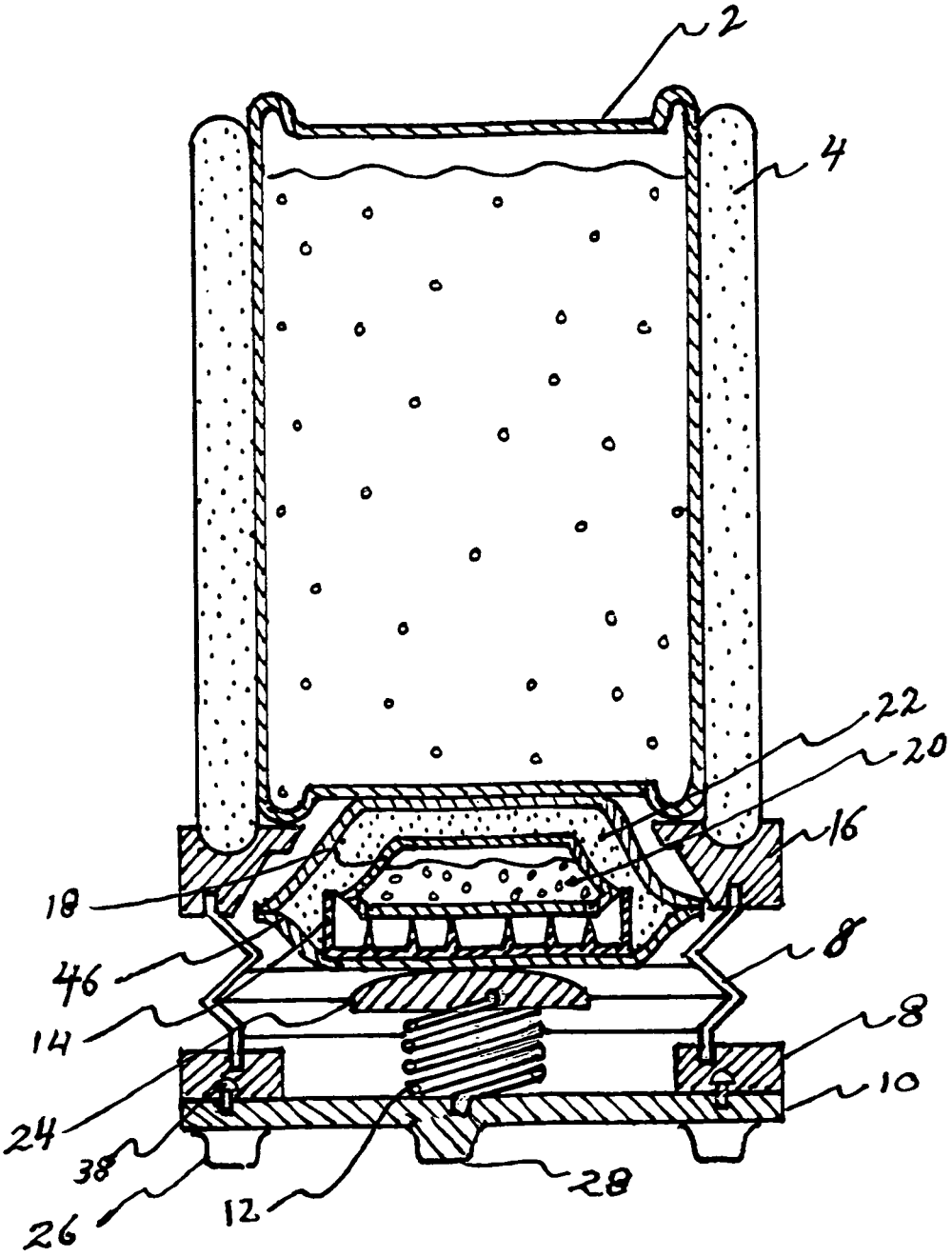
FIG. 2 is a side section view of the invention.
Figure 3:
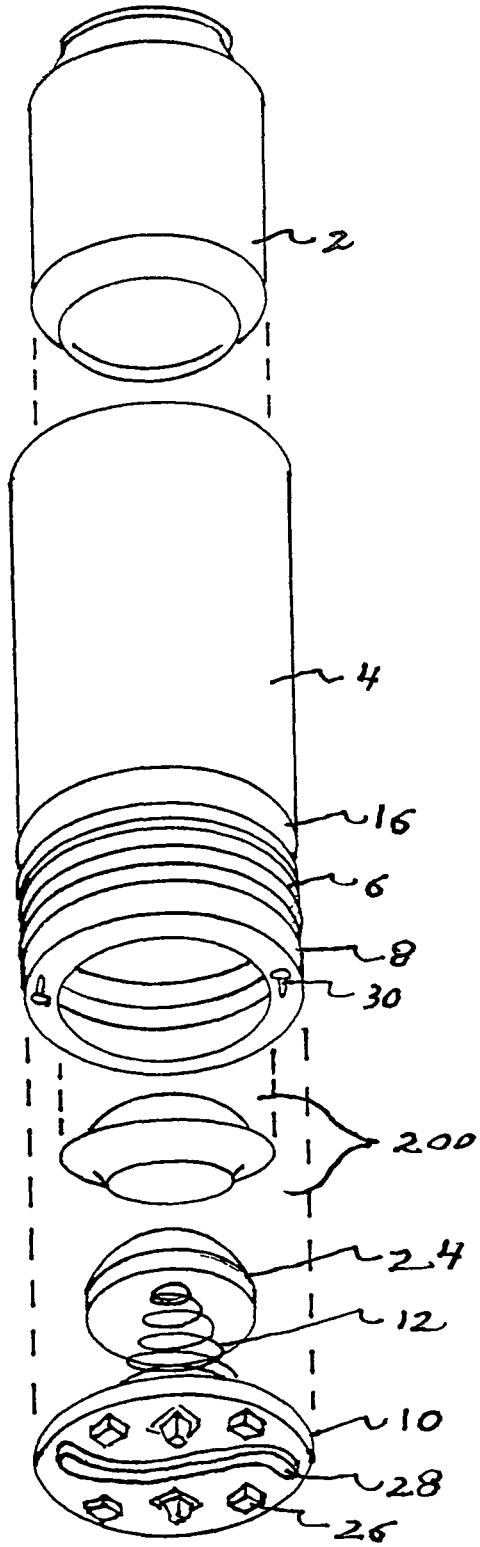
FIG. 3 is an exploded view of the invention.

FIG. 2 shows a bisected view of the invention with a can 2 in place. Insulating sleeve 4 can be seen attached at its bottom to circular ring 16. A cooling cartridge 200, as shown in the exploded view in FIG. 3, is constructed of an outer flexible enclosure 46 that holds a chemical powder 22, a rigid plate 14 having upwardly directed prongs attached and an inner flexible enclosure 18 containing a chemical liquid 20. A compression spring 12 is attached at its bottom to bottom plate 10 and at the top to push plate 24. Feet 26 hold the entire assembly in a stable position while on a flat surface. Turning rib 28 allows the user to twist the bottom plate 10 so that screw head 38 can be removed from retaining slot 30 as shown in the exploded view in FIG. 3. To activate the cooling cartridge 200, the user presses on the top of the can 2 which causes push plate 24 to compress upwardly on prong plate 46 which then bursts inner enclosure 18 causing the liquid 20 within enclosure 18 to escape and mix with powder 22. Compression spring 12 causes cooling enclosure 46 in close contact with the bottom of can 2 so that the cooling influence of the cooling cartridge 200 can be most effective. Insulating sleeve 4 helps keep the can cool for longer periods of time.

FIG. 3 shows an exploded view of the invention 100. The turning rib 28 can be clearly seen. The rib is grasped by the user's fingers and turned slightly to remove screw heads 38 from keyholes 30.

Figure 4:
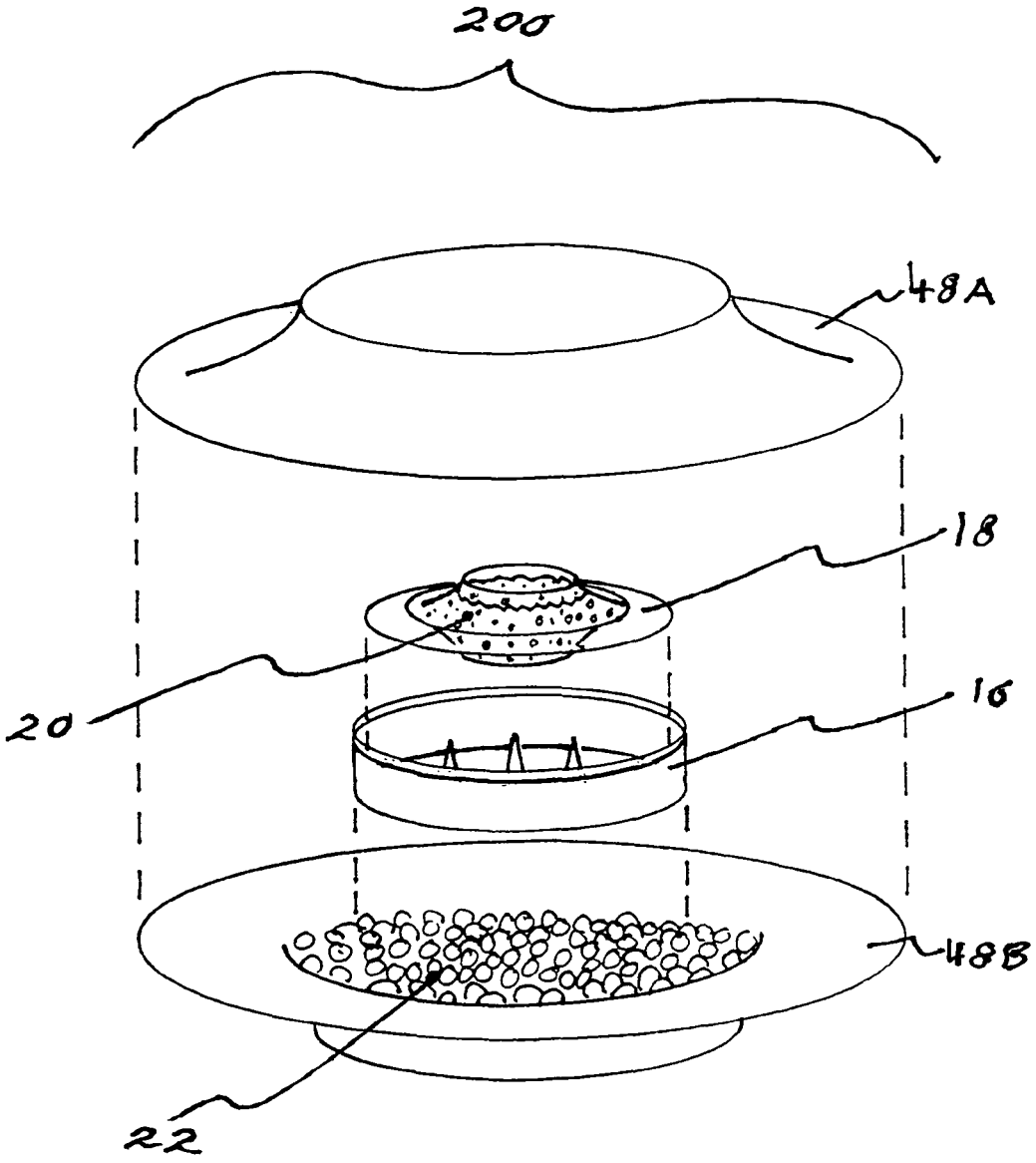
FIG. 4 is an exploded view of the cooling cartridge of the invention.

FIG. 4 shows an exploded view of the cooling cartridge 200. Outside flexible enclosure 48 is made of a top member 48A and a bottom member 48B that are heat welded together at their perimeter. Inner enclosure 18 is constructed in a similar way. Rigid plate 16 with prongs also includes a perimeter side wall to help hold inner enclosure 18 in a central location. Powder 22 can be seen resting inside bottom member 48B.

Figure 5:
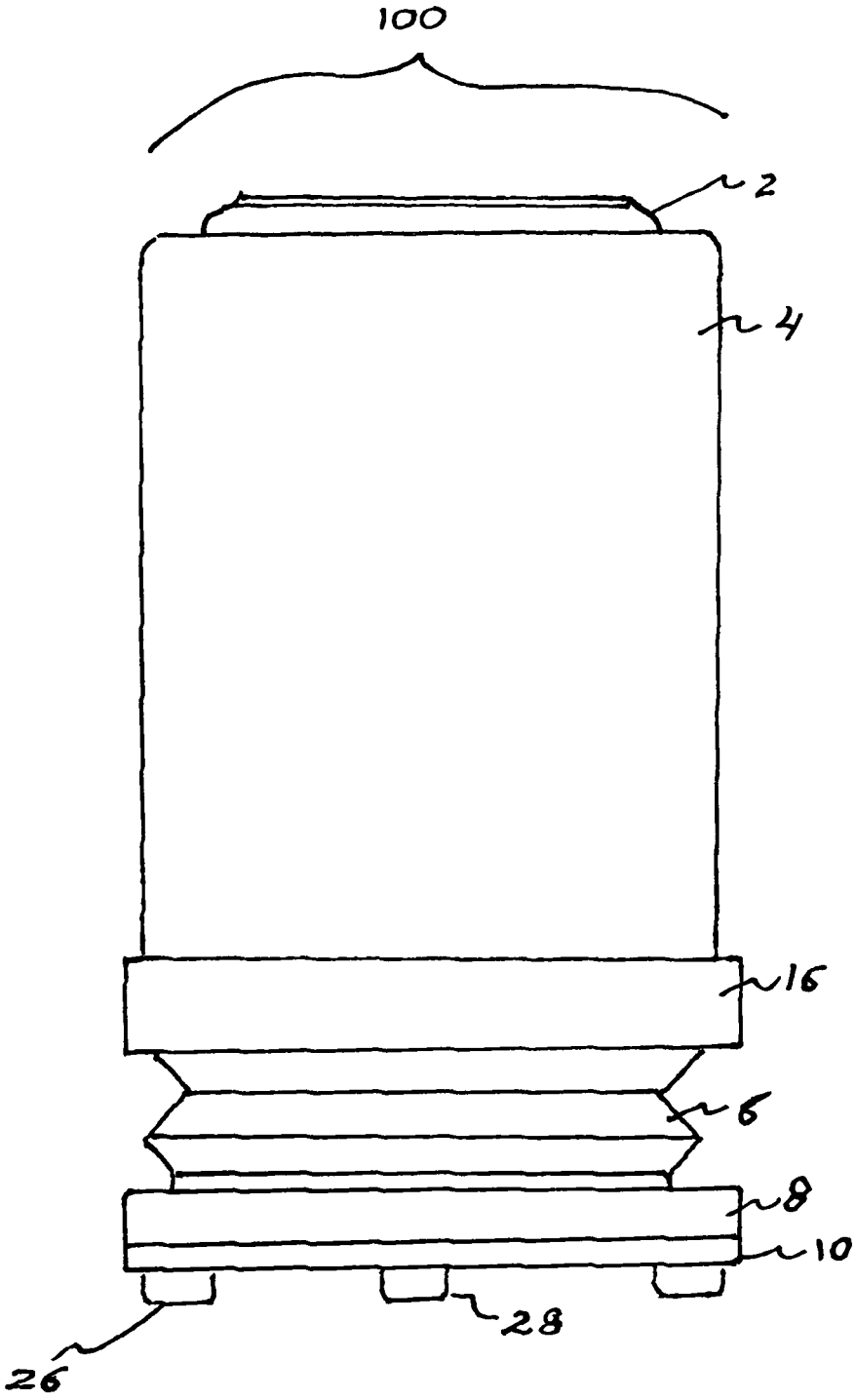
FIG. 5 is a side view of the invention.

FIG. 5 is a side view of the invention 100 shown for clarity purposes.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. can cooling device comprising:

a can insulating sleeve;

a rigid sleeve retaining ring;

an cylindrical flexible bellows;

a bellows bottom rigid retaining ring;

a rigid bottom plate;

a chemically activated cooling cartridge;

a cartridge push plate;

a compression spring;

said can insulating sleeve fixedly connected to the top of said rigid sleeve retaining ring;

the top portion of said cylindrical bellows fixedly attached to the bottom portion of said rigid sleeve retaining ring;

the bottom portion of said cylindrical bellows fixedly attached to the top portion of said bellows bottom rigid retaining ring;

said cooling cartridge removably retained within said cylindrical bellows;

the top of said compression spring attached to the underside of said cartridge push plate;

said push plate providing an upwardly directed force to help said cooling cartridge be in intimate contact with the underside of a beverage can located within said can insulating sleeve;

the bottom of said compression spring attached to the top surface of said rigid bottom plate;

said bottom plate removably retained by attachment means to the underside of said bellows bottom retaining rigid ring;

said cooling cartridge comprised of an outer flexible enclosure which houses a powder material, a rigid plate having attached upwardly directed prongs an an inner flexible enclosure housing a liquid;

so that when a user presses down on said beverage can, said cooling cartridge is compressed causing said upwardly directed prongs to impale said liquid holding flexible inner enclosure and causing said liquid to mix with said powder causing an endothermic cooling reaction; and said cooling reaction causing said beverage can to be cooled in relation to said surrounding outside temperature.

* * * * *